United States Patent [19]

Hasagawa

[11] Patent Number: 4,934,599

[45] Date of Patent: Jun. 19, 1990

[54] FUEL INJECTION NOZZLE FOR TWO-STAGE FUEL INJECTION

[75] Inventor: Shumpei Hasagawa, Saitama, Japan

[73] Assignee: Honda Giken Kogyo Kabushiki Kaisha, Tokyo, Japan

[21] Appl. No.: 255,035

[22] Filed: Oct. 7, 1988

[30] Foreign Application Priority Data

Oct. 7, 1987 [JP] Japan ..... 62-253094

[51] Int. Cl.[5] ..... F02M 47/02

[52] U.S. Cl. ..... 239/88; 239/533.8; 239/533.9

[58] Field of Search ..... 239/533.3–533.12, 239/88, 90, 91

[56] References Cited

U.S. PATENT DOCUMENTS

| | | | |
|---|---|---|---|
| 2,898,051 | 8/1959 | Teichert | 239/533.5 |
| 2,927,737 | 3/1960 | Zeuch et al. | 239/533.3 |
| 3,006,556 | 10/1961 | Shade et al. | 239/533.7 |
| 4,215,821 | 8/1980 | Eblen | 239/533.8 |
| 4,269,360 | 5/1981 | Kopse | 239/533.8 |
| 4,403,740 | 9/1983 | Eblen et al. | 239/533.4 |
| 4,499,871 | 2/1985 | Neitz et al. | 239/533.8 |
| 4,528,951 | 7/1985 | Yamada | 239/533.4 |
| 4,669,668 | 6/1987 | Ogawa | 239/533.8 |

*Primary Examiner*—Andres Kashnikow
*Assistant Examiner*—Michael J. Forman
*Attorney, Agent, or Firm*—Lyon & Lyon

[57] ABSTRACT

A fuel injection nozzle comprising a needle valve which is lifted away from a valve seat against the spring force of a pressure spring by receiving pressure from the fuel to be injected. The lift of the needle valve thus causes the fuel to be injected into a combustion chamber of an internal combustion engine. The lift of the needle valve takes place in two stages, in particular by reducing the amount of initial fuel injection, to reduce engine knock. This is accomplished by the provision of a movable, cylindrical plunger which abuts the needle valve at a certain lift thereof and restricts further lift of the needle valve by being subjected to the pressure from the fuel to be injected. Thus, the increase in the rate of fuel injection is restricted to an optimum level.

5 Claims, 3 Drawing Sheets

FUEL INJECTION NOZZLE FOR TWO-STAGE FUEL INJECTION

TECHNICAL FIELD

The present invention relates to a fuel injection nozzle for internal combustion engines such as diesel engines, and in particular to such a fuel injection nozzle adapted for two-stage fuel injection.

BACKGROUND OF THE INVENTION

Conventionally, it has been known that if the injection pressure rises too sharply in an early stage of fuel combustion, engine knocking tends to occur. Therefore it is possible to reduce the combustion noises of diesel engines by controlling the rate of fuel injection in the early stage of fuel injection. This can be achieved by injecting fuel in two-stages.

In a typical fuel injection nozzle, the needle valve is biased toward the closing direction by a pressure spring and is lifted against the spring force of the pressure spring by the pressure from the fuel. By using two pressure springs, it is possible to control the fuel pressure vs. needle valve lift curve, but the structure of the nozzle assembly becomes excessively complex.

Japanese utility model laid open publication No. 59-17268 discloses a needle valve for a fuel injection nozzle which is provided with a port and passage which controls the back pressure acting upon the needle valve according to its lift in cooperation with a fixed part of the nozzle body. However, provision of such a spool valve structure at the upper end of the needle valve involve an increase in the manufacturing cost.

Japanese patent laid open publication No. 58-204962 discloses an electronically controlled fuel injection system. Each nozzle assembly is provided with a pair of solenoid valves, and they must be controlled with a complex control unit. Thus, this also involves high cost and complexity of structure.

BRIEF SUMMARY OF THE INVENTION

In view of such problems of the prior art, a primary object of the present invention is to provide a fuel injection nozzle for two-stage fuel injection which can effectively reduce the combustion noise with a simple and economic structure.

According to the present invention, this and other objects can be accomplished by providing a fuel injection nozzle, comprising: a nozzle body defining a first chamber which is subjected to a fuel injection pressure, a second chamber which is subjected to a back pressure substantially lower than said fuel injection pressure, and a fuel injection hole for injecting fuel into a combustion chamber of an internal combustion engine; a fuel passage provided in said nozzle body for conducting fuel placed under said fuel injection pressure to said fuel injection hole; a needle valve received in said nozzle body and provided with a first pressure receiving surface for receiving said fuel injection pressure and a valve element adapted to cooperate with a valve seat provided in said fuel passage upstream of said fuel injection hole; and a pressure spring urging said needle valve against said valve seat; said needle valve being lifted away from said valve seat against the spring force of said pressure spring when said fuel injection pressure applied to said first pressure receiving surface of said needle valve is more dominant than the spring force of said pressure spring; further comprising: a pressure member received slidably in said nozzle body between a first position and a second position, said needle valve coming into contact with said pressure member a said first position when said needle valve is at an intermediate point of the upward lift stroke thereof, and moving said pressure member to said second position as said needle valve reaches the end of said upward lift stroke; said pressure member being provided with a second pressure receiving surface for receiving said fuel injection pressure in the direction to oppose the motion of said pressure member caused by said needle valve.

According to a preferred embodiment of the present invention, said pressure member comprises a cylindrical plunger member which is passed through a wall member which separates said first chamber from said second chamber. Further, said pressure member may be provided with a head at its one end which abuts said wall member from said first chamber when said pressure member is at said first position. Optionally, said pressure spring may comprise a compression coil spring interposed between said wall member and an upper end of said needle valve inside said second chamber, and said plunger member may extend coaxially to and inside said compression coil spring. And, preferably, said upper end of said needle valve abuts the lower end of said plunger member when said needle valve is at said intermediate point of the upward lift stroke thereof. These features offer the advantages in the compactness and simplicity of design.

If said head abuts said wall member by way of local projections, the second pressure receiving surface is so well defined that a stable action of the pressure member is assured.

According to a particularly preferred embodiment of the present invention, said needle valve is provided with an annular shoulder surface for defining the end of the upward lift stroke of said needle valve in cooperation with a part of said nozzle body. This feature offers a highly rigid and durable stopper structure for the needle valve.

When the fuel injection nozzle of the present invention is built as a unit injector, said first chamber may directly communicate with the interior of a cylinder barrel of said fuel injection pump unit by way of a fuel passage extending through an end wall member of said cylinder barrel. Thereby, an extremely compact, durable and economical unit injector can be provided.

BRIEF DESCRIPTION OF THE DRAWINGS

Now the present invention is described in the following in terms of specific embodiments with reference to the appended drawings, in which.

DETAILED DESCRIPTION OF THE PREFERRED EMBODIMENTS

Figure 1:
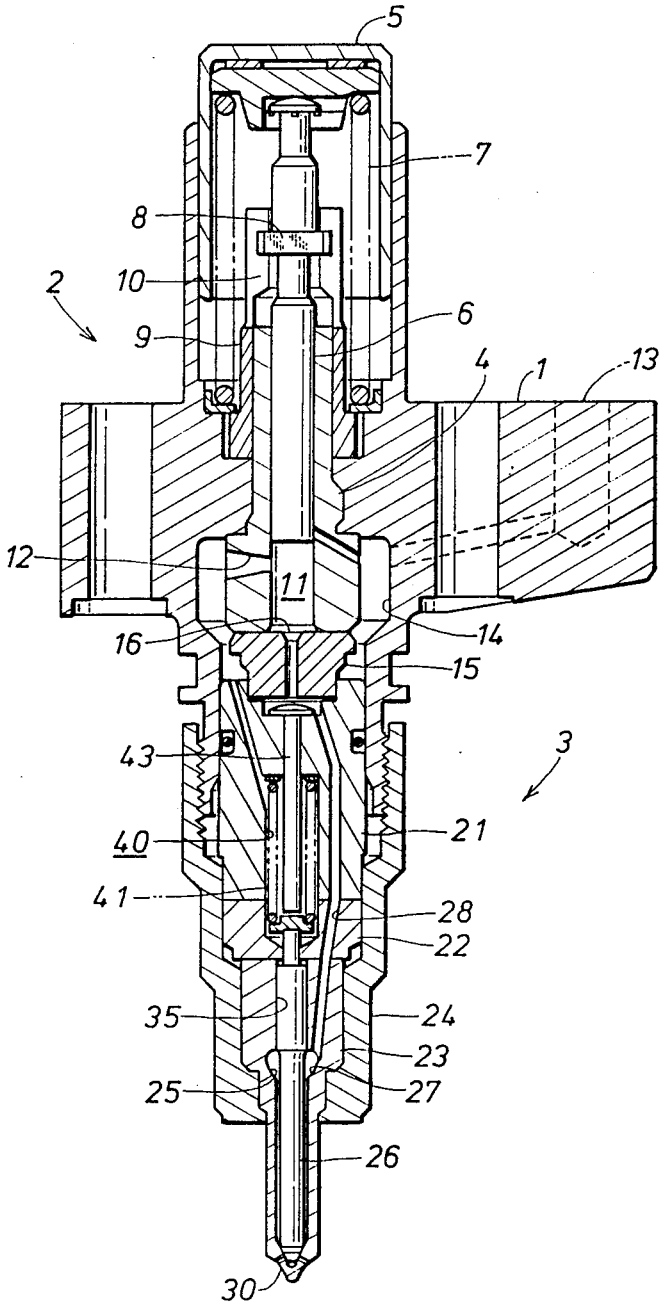
FIG. 1 is a sectional view of a first preferred embodiment of the present invention.

FIG. 1 shows a general view of a unit injector for a diesel engine to which the present invention is applied; this unit injector combines a pump unit 2 accommodated in the upper part of the housing 1 and a nozzle unit 3 accommodated in the lower part of the housing 1.

The pump unit 2 comprises a plunger 6 which is slidably received in a cylinder barrel 4 along the axial direction and is engaged to a tappet 5 at its upper end. As the tappet 5 is urged into the housing 1 by a cam (not shown in the drawing) driven by the engine against the spring force of a compression coil spring 7 and out of the housing 1 by the compression coil spring 7 in an alternating manner, the plunger 6 reciprocates in the cylinder barrel 4 in synchronism with the rotation of the engine. A driving face 8 of the plunger 6 is received in a slot 10 of a sleeve 9 which is rotatably supported around the cylinder barrel 4 in such a manner that the plunger 6 may be turned around its axial center line by turning the sleeve 9 from outside with a control arm not shown in the drawing without hindering the reciprocating motion of the plunger 6. As well known, the lower end of the plunger 6 is provided with a helical slot (not shown in the drawings) for adjusting the effective stroke of the plunger 6 in cooperation with an inlet port 12 provided in the cylinder barrel 4, by turning the plunger 6.

The inlet port 12 communicates the delivery chamber 11 defined by the cylinder barrel 4 and the lower end of the plunger 6 with a fuel gallery 14 which receives a supply of fuel at constant feed pressure from a fuel supply inlet 13. The lower end of the fuel delivery chamber 11 is defined by a end wall member 15 which defines, at its center, an axial fuel passage 16 which conducts the pressurized fuel from the delivery chamber 11 to an injection chamber 25 of the nozzle unit 3 as described hereinafter.

Figure 2:
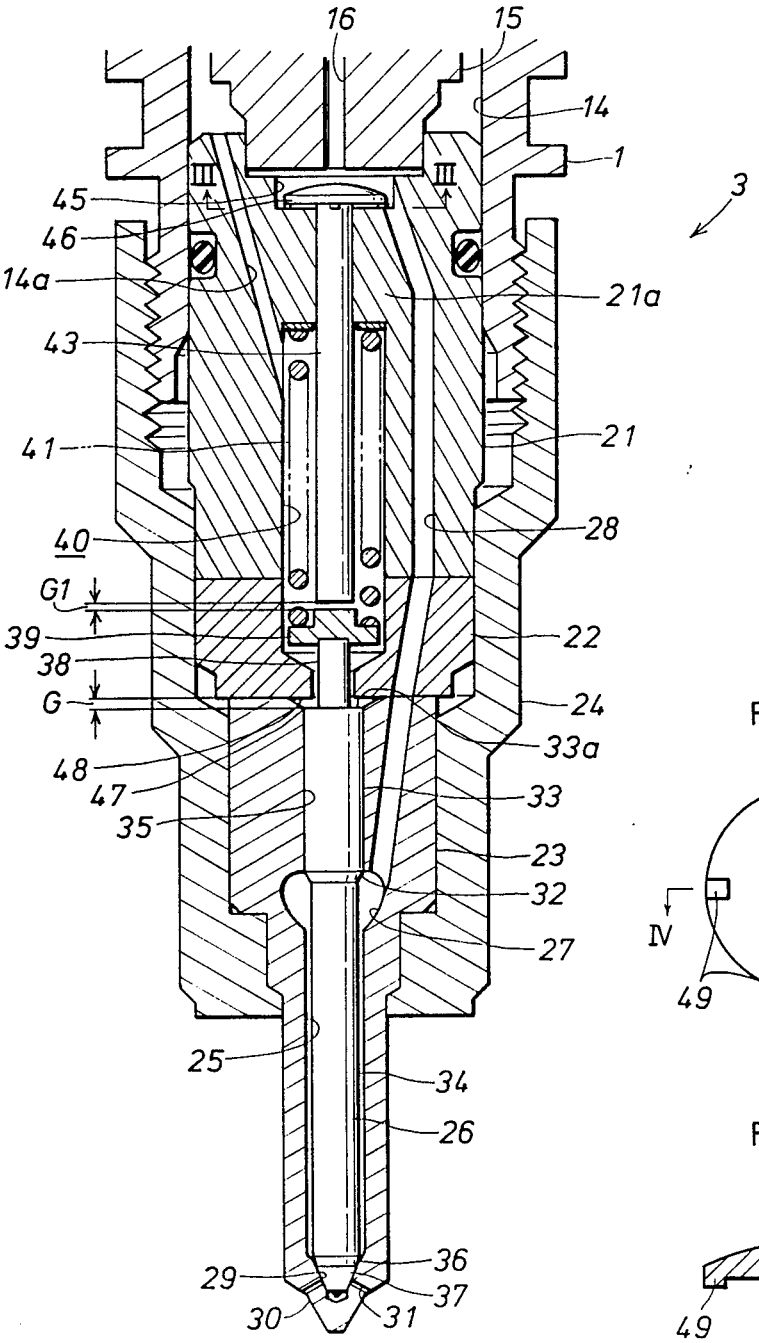
FIG. 2 is an enlarged view of a part of FIG. 1.

Referring to FIG. 2, the nozzle unit 3 is provided with a nozzle body consisting of a nozzle holder body 21 which abuts the lower end of the end wall member 15, a distance piece 22 and a nozzle main body 23 which is received in a retaining nut 24 at its upper end and protrudes downwardly from the retaining nut 24 at its lower end. The retaining nut 24 is threaded with the housing 1 and securely holds the end wall member 15, the nozzle holder body 21, the distance piece 22 and the nozzle main body 23 together.

The nozzle main body 23 defines the injection chamber 25 therein, and the injection chamber 25 receives a needle valve 26 therein. The injection chamber 25 comprises a radially expanded fuel reservoir 27 which communicates with the deliver chamber 11 via a fuel passage 28 which extends through the nozzle holder body 21, the distance piece 22 and the nozzle main body 23 and communicates with the fuel passage 16 of the end wall member 15.

A valve seat 29 is provided in the nozzle main body 23 at the bottom end of the injection chamber 25 for cooperation with the needle valve 26, and the conical tip 30 of the nozzle main body 23 is provided with a plurality of injection holes 31 which open in the valve seat 29.

The needle valve 26 comprises a large diameter portion 33 and a small diameter portion 34 which are divided by an annular step 32. The large diameter portion 33 is slidably received in a guide bore 35 provided in the nozzle main body 23. The outer circumferential surface of the small diameter portion 34 of the needle valve 26 is spaced from the inner circumferential surface of the nozzle main body 23 defining the injection chamber 25 therebetween. The needle valve 26 is biased downwardly, by way of a push pin 38 integrally and coaxially formed at the upper end of the needle valve 26 and a retainer 39 attached to the upper end of the push pin 38, by a compression coil spring (pressure spring) 41 received in a back pressure chamber 40 communicating with the fuel gallery 14 by way of an oblique fuel passage 14*a*.

Figure 5:
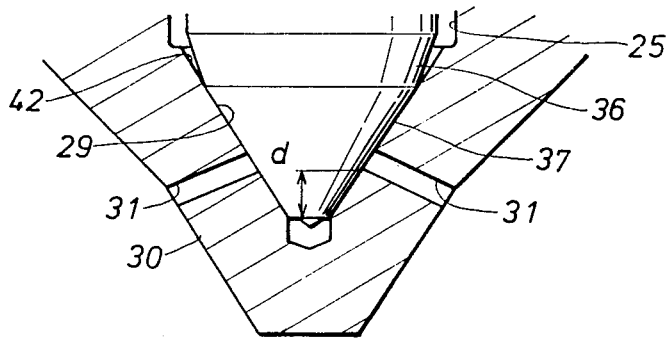
FIG. 5 is an enlarged view of the tip of the nozzle shown in FIGS. 1 and 2.

As best shown in FIG. 5, the lower end of the needle valve 26 is provided with a first conical surface 37 which normally rests upon the valve seat 29 under the spring force of the pressure spring 41, and a second conical surface 36 which has a smaller divergence angle than the first conical surface 37 and is located between the first conical surface 37 and the cylindrical small diameter portion 34 of the needle valve 26.

Referring to FIG. 2, there is a small gap G between the annular upper end surface 33*a* of the large diameter portion 33 of the needle valve 26 and the lower end surface 48 of the distance piece 22 around the bore defined in the distance piece for passing the push pin 38 therethrough. This gap G determines the maximum lift of the needle valve 26.

Figure 3:
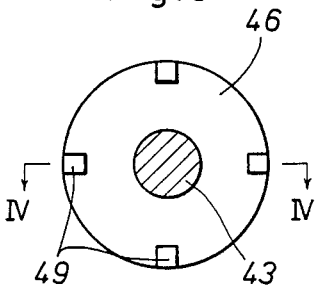
FIG. 3 is a sectional view taken along line III—III of FIG. 2.
Figure 4:
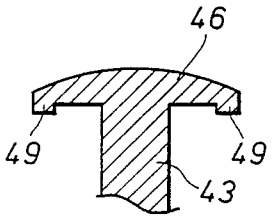
FIG. 4 is a sectional view taken along line IV—IV of FIG. 3.

A central plunger 43 is passed axially through a wall portion 21*a* in the upper most part of the nozzle holder body 21 in axially slidable manner and coaxially with the needle valve 26. As best shown in FIGS. 3 and 4, the upper end of the central plunger 43 is provided with a head 46 which rests upon the upper surface of the nozzle holder body 21 which defines an intermediate chamber 45 in cooperation with the end wall member 15. This chamber 45 communicates the fuel passage 16 with the fuel passage 28. The under-surface of the head 46 is provided with four projections 49 which are equally spaced along the circumferential direction to space the under-surface of the head 46 from the upper surface of the nozzle holder body 21. Since the pressure of the intermediate chamber 45 is generally higher than the pressure of the back pressure chamber 40, the central plunger 43 is normally urged downwardly by this pressure difference.

The lower end of the central plunger 43 is spaced from the upper end of the retainer 39 by a small gap $G_1$ which is smaller than the gap G between the upper end of the large diameter portion 33 and the lower end surface of the distance piece 22. This gap $G_1$ determines the first stage lift of the needle valve 26 as described hereinafter. In the present embodiment, the total lift G is 200 micrometers, and the first stage lift $G_1$ is selected from a range of between 20 and 30 micrometers. Generally speaking, the first stage lift should be selected to be larger than one twentieth of the total lift, and, more preferably, should be approximately one tenth of the total lift.

The nozzle unit 3 of the present embodiment consists of a hole nozzle as best shown in FIG. 5. A small gap is defined between the second conical surface 36 and the valve seat 29 defining an annular chamber 42 therebetween. In this nozzle unit 3, since the injection holes 31 open in the valve seat 29 which closely contacts the first conical surface 37 of the needle valve 26, the volume of the fuel sac is extremely small as it consists almost solely from the injection holes 31. Therefore, the dripping of fuel following each fuel injection can be minimized and this contributes to the reduction of hydrocarbon emission for the engine.

Now the mode of operation of the present embodiment is described in the following:

When the cam lift is zero and the plunger 6 is at its higher most position as shown in FIG. 1, fuel of a constant feed pressure (for instance, approximately 1.5 $kg/cm_2$) is introduced into the delivery chamber 11 by way of the fuel inlet 13, the fuel gallery 14 and the inlet port 12. As the plunger 6 is pushed downward by the cam lift, the inlet port 12 is closed by the plunger 6 and the fuel captured in the delivery chamber 11 is gradually pressurized and conducted to the injection chamber 25 by way of the fuel passages 16 and 28. The pressure of the fuel in this stage is extremely high and may reach, for instance approximately 1,500 $kg/cm_2$.

The fuel pressure in the injection chamber 25 acts upon the annular step 32 of the needle valve 26 and the second conical surface 36 and, when an enough pressure has been built up, pushes the needle valve 26 against the spring force of the pressure spring 41. Since the central plunger 43 is subjected to a pressure substantially equal to the pressure of the injection chamber 25 from above, the upward movement of the needle valve 26 is limited when it abuts the lower end of the central plunger 43 after the distance $G_1$. As a result of the first stage lift of the needle valve 26, a small gap is defined between the first conical surface 37 of the needle valve 26 and the valve seat 29 of the nozzle main body 23, and a certain amount of fuel is injected into the combustion chamber of the engine from the injection holes 31.

However, since any further lift of the needle valve 26 is limited by the central plunger 43, the rate of fuel injection is limited until enough pressure is built up in the injection chamber 25 to lift the needle valve 26 against the pressure acting upon the central plunger 43. By thus limiting the amount of initial fuel injection, the occurrence of knocking is minimized and engine noise is reduced.

As the plunger 6 moves further downward and the fuel pressure in the delivery chamber 11 increases, the corresponding increase in the fuel pressure in the injection chamber 25 causes a further upward movement of the needle valve 26 against the combined force of the spring force of the pressure spring 41 and the fuel pressure acting upon the central plunger 43 with the fuel pressure acting upon the first conical surface 37 in addition to the second conical surface 36 and the annular step 32. When the annular upper end surface **33*a* of the large diameter portion 33 of the needle valve 26 finally abuts the lower end surface 48 of the distance piece 22, the upward motion of the needle valve 26 stops. By this second stage lift of the needle valve 26, the gap between the first conical surface 37 of the needle valve 26 and the valve seat 29 is maximized and a larger amount of fuel is injected from the injection holes 31** at higher pressure.

As the fuel pressure in the injection chamber 25 drops lower than a certain level subsequent to this two-stage fuel injection, the needle valve 26 is restored to the original position under the spring force of the pressure spring 41 and the first conical surface 37 of the needle valve 26 comes into contact with the valve seat 29. This completes the full cycle of fuel injection. The plunger 6 is then pushed upward by the action of the return spring 7 as permitted by the profile of the drive cam, and a fresh supply of fuel is introduced into the delivery chamber 11.

Figure 6:
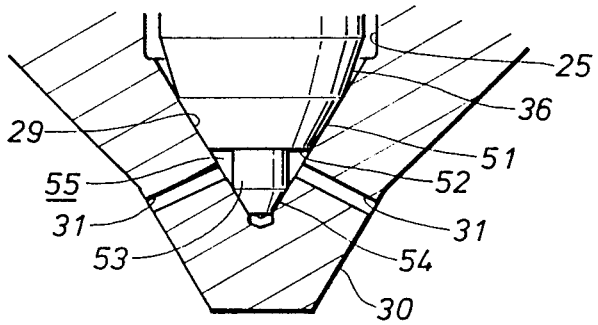
FIGS. 6 and 7 are views similar to FIG. 5 showing different embodiments of the present invention.
Figure 7:
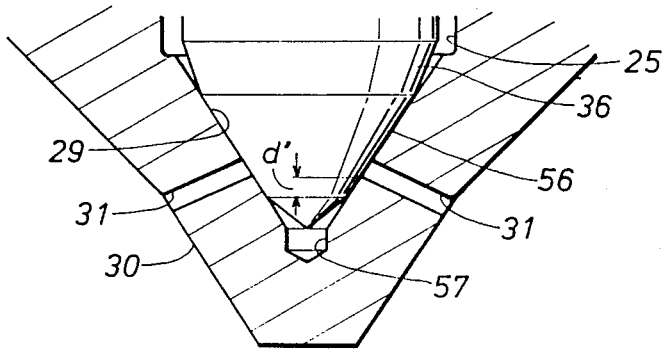

FIGS. 6 and 7 show different embodiments of the nozzle unit.

In the embodiment of FIG. 6, the first conical surface is divided into two parts 51 and 54 by an annular sac 55 defined by a shoulder surface 52 of the upper part 51 of the first conical surface, and a cylindrical pin 53 of a reduced diameter extending between the two parts 51 and 54. Therefore, a substantial sac volume is formed by the annular sac 55 and the injection holes 31, but this contributes to a uniform injection from the injection holes 31 with the annular sac 55 serving as a plenum chamber.

The embodiment of FIG. 7 is similar to that shown FIG. 5, but the width of the first conical surface 56 is less than that shown in FIG. 5. Therefore, the distance $d_1$ between the lower edge of the first conical surface 56 and the lower edge line of the injection holes 31 of the nozzle unit shown in FIG. 7 is less that the corresponding distance d of the nozzle unit in FIG. 5. Therefore, in this embodiment also, a substantially larger sac chamber 57 is defined at the lower end of the tip 30 of the nozzle unit 3.

Thus, according to the present invention, since the lift of the needle valve occurs in two stages according to the rise in the fuel injection pressure, control of the valve opening pressure can be easily effected and, in particular, the amount of initial fuel injection can be finely adjusted. Therefore, the present invention offers a considerable advantage in reducing the combustion noises in diesel engines. Further, the present invention additionally offers a compact design of injection nozzle.

What we claim is:

1. A fuel injection nozzle, comprising: a nozzle body defining a first chamber which is selectively subjected to a fuel injection pressure from a fuel injection pump, a second chamber which is subjected to a back pressure substantially lower than said fuel injection pressure from a fuel supply, and a fuel injection hole for injecting fuel into a combustion chamber of an internal combustion engine; a fuel passage provided in said nozzle body for conducting fuel placed under said fuel injection pressure from said first chamber to said fuel injection hole; a needle valve received in said nozzle body and provided with a first pressure receiving surface for receiving said fuel injection pressure and a valve element adapted to cooperate with a valve seat provided in said fuel passage upstream of said fuel injection hole; a pressure spring urging said needle valve against said valve seat, said needle valve being lifted away from said valve seat in an upward lift stroke against the spring force of said pressure spring when said fuel injection pressure applied to said first pressure receiving surface of said needle valve is more dominant than the spring force of said pressure spring; and a cylindrical plunger member which is passed through a wall member separating said first chamber from said second chamber so as to be slidable between a first position and a second position and is provided with a head at its one end which abuts said wall member from said first chamber by way of projections provided on an underside of said head when said plunger member is at said first position, said needle valve coming into contact with a free end of said plunger member located in said second chamber when said needle valve is at an intermediate point of the upward lift stroke thereof, and moving said plunger member to said second position as said needle valve reaches the end of said upward lift stroke.

2. A fuel injection nozzle as defined in claim 1, wherein said pressure spring comprises a compression coil spring interposed between said wall member and an upper end of said needle valve inside said second chamber, and said plunger member extends coaxially to and inside said compression coil spring.

3. A fuel injection nozzle as defined in claim 1, wherein said needle valve is provided with an annular shoulder surface for defining the end of the upward lift stroke of said needle valve in cooperation with a part of said nozzle body.

4. A fuel injection nozzle as defined in claim 1, wherein said nozzle body is integrally connected to the fuel injection pump, and said first chamber directly communicates with an interior of a cylinder barrel of said fuel injection pump unit by way of a fuel passage extending through an end wall member of said cylinder barrel.

5. A fuel injection nozzle as defined in claim 1, wherein said head consists of a flat discus shape, and said projections are provided along a peripheral part of said underside of said head.

* * * * *